United States Patent [19]

Maar

[11] Patent Number: 4,536,165

[45] Date of Patent: Aug. 20, 1985

[54] BATHEABLE DOLL

[75] Inventor: Lienhard Maar, Rödental, Fed. Rep. of Germany

[73] Assignee: Firma Max Zapf, Rödental, Fed. Rep. of Germany

[21] Appl. No.: 672,866

[22] Filed: Nov. 19, 1984

Related U.S. Application Data

[63] Continuation of Ser. No. 459,591, Jan. 20, 1983, abandoned.

[30] Foreign Application Priority Data

Feb. 2, 1982 [DE] Fed. Rep. of Germany ..... 3203360
Nov. 13, 1982 [DE] Fed. Rep. of Germany ..... 3242178

[51] Int. Cl.[3] ..... A63H 23/00; A63H 3/46
[52] U.S. Cl. ..... 446/153; 446/376
[58] Field of Search ..... 446/153, 156, 226, 268, 446/369, 371, 373, 375, 376, 378, 379, 383, 390, 385

[56] References Cited

U.S. PATENT DOCUMENTS

| | | | |
|---|---|---|---|
| 2,118,682 | 5/1938 | Nagel | 46/161 |
| 2,503,948 | 4/1950 | Henry | 46/159 X |
| 2,777,252 | 1/1957 | Tancredi et al. | 46/117 X |
| 3,065,566 | 11/1962 | Sugimoto | 46/87 |
| 3,699,715 | 10/1972 | Lewis et al. | 446/376 |
| 3,816,957 | 6/1974 | Nakajima | 446/379 |

*Primary Examiner*—Mickey Yu
*Attorney, Agent, or Firm*—Holman & Stern

[57] ABSTRACT

The invention relates to an immersible toy, particularly a liquid-tight batheable doll which has a body which is flexible when grasped, conveying a skin-like sensation; and which has arms, legs, and a head which can undergo relatively free motion after the fashion of a baby's movements, and which can be mounted easily without damage to the delicate body skin. The toy includes joining structures for the appendages, having closed sleeve elements extending from the torso for receiving the appendages, and retaining elements for attaching the appendages to the sleeve elements.

5 Claims, 6 Drawing Figures

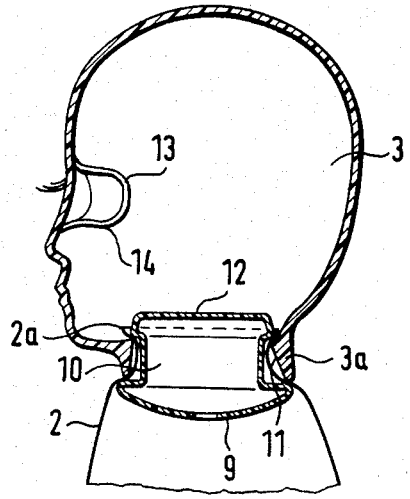
FIG. 3
FIG. 2a
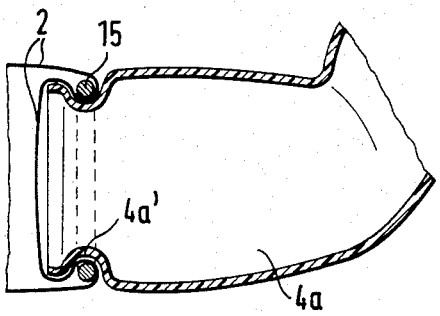
FIG. 4a
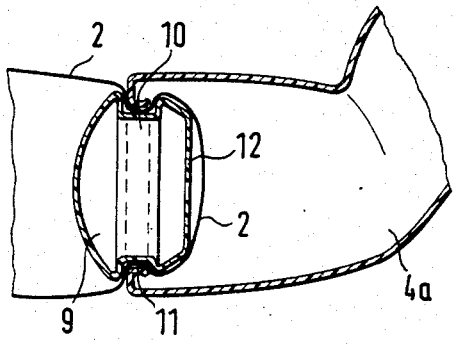
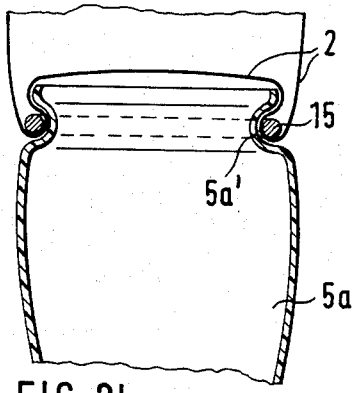
FIG. 2b
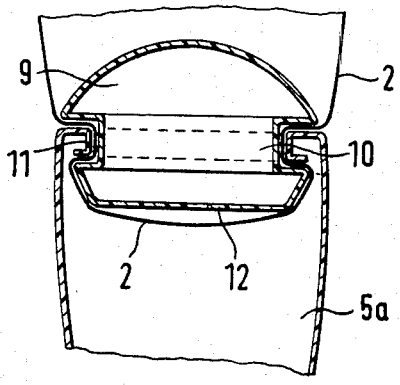
FIG. 4b

BATHEABLE DOLL

This is a continuation of application Ser. No. 459,591, filed Jan. 20, 1983, now abandoned.

BACKGROUND OF THE INVENTION

1. Field of the Invention

The invention relates to an immersible toy, especially a batheable doll comprising a torso with a water-resistant skin; and appendages comprising a head, arms, and legs which are moveably attached to said torso.

2. Description of the Prior Art

A batheable doll should seem to the child playing with it to be similar to a newborn baby or infant being bathed by the baby's mother. The torso of such a doll should convey a sense of a skin-like flexibility when grasped, and its arms, legs, and head should be moveable to a relatively uncontrolled extent. Further, it must be water-resistant.

The known examples of batheable dolls do not satisfy these conditions. Generally only the so-called "soft dolls" have flexible bodies. These bodies are stuffed with flexible material, and have a fabric cover such as muslin or cotton. Such a cover does not resemble skin when grasped, and in particular it is not suitable for bathing with water; accordingly, such dolls are not useable as batheable dolls.

Instead, batheable dolls are commonly fabricated of polyvinyl chloride. Their skin is of necessity very thick, in order to permit the provision of joints for the head, arms, and legs in the regions of the neck, shoulders, and hips of the torso. This thick skin affords little in the way of flexibility or a skin-like sensation; moreover, the joints tend to leak and to admit water into the doll's body cavity, so that the doll becomes unnaturally heavy. Further, the water may later come out at an undesirable time and/or in an improper place, e.g. when a child is sleeping in bed with the doll.

SUMMARY OF THE INVENTION

The invention thus provides a batheable doll which does not have these disadvantages. This is achieved according to the invention by providing water-tight joining means for joining the head and limbs to the torso of the doll, broadly comprising invertible closed sleeve extensions at the neck, hips, and shoulders of the torso for receiving the limbs and head in the inverted portion thereof, and attachment means for attaching the limbs and head to the torso within the inverted sleeve extensions. The torso of the doll may in consequence be soft-stuffed without danger of the stuffing becoming wetted during bathing, and the skin may be very thin and pliable. Preferably, the attachment means permits the limbs and neck to be freely moveable with respect to the torso; these appendages may suitably be fixed, or removeably engageable with the torso, as desired.

These improvements completely eliminate the prior art disadvantages. The thin skin is so flexible that it yields even under the relatively weak pressure of a child's hand; when the pressure is released, it can return to its initial shape. The thin skin may be fabricated of a plastic material so that it feels like human skin. Finally, the joining means used for mounting the head, arms, and legs to the skin of the body is completely water-tight. Since with this type of connection there are no joints per se, the head and limbs are not limited to a narrow range of motion but can be moved in a relatively uncontrolled manner, after the fashion in which a baby moves.

In one embodiment of the invention, the skin of the body of the doll is 0.2 to 0.8 mm thick, and is preferably comprised of latex rubber or soft polyvinyl chloride material. Obviously, the body skin thickness chosen will depend on the type of plastic employed; thus, it is conceivable that a skin of very soft polyvinyl chloride might be thicker than the stated limit of 0.8 mm.

As is know for stuffed dolls, the torso and appendages of the invention doll may be stuffed with a soft fibrous material such as cotton batting. This material has inherent elasticity which ensures that the body will return to its original shape each time it suffers a shape-altering compression force.

In a particular embodiment of the invention, the sleeve extensions are in the form of extensions of the body skin integral with the skin and of approximately the same wall thickness. Preferably, all of these extensions except one are closed. The open one, which advantageously may be the extension at the neck of the torso, serves to admit the soft stuffing into the interior cavity of the body. The fact that the extensions are all integral with the body skin, and are all, or nearly all, closed, ensures water-tightness. At the same time, the thinness of their walls facilitates the attachment of the head, arms, and legs, since thin-walled extensions are easier to manipulate than would be thick-walled extensions which would be relatively stiff. Also, the type of swinging and flexing movements of the head, arms and legs experienced with the thin-walled extensions are very similar to a baby's movements. The head, arms, and legs are made somewhat heavy in order to promote this effect; as a result the overall weight of the doll is realistic, whereas otherwise it would be too light.

The choice of the neck extension to be open is a consequence of its having the largest cross section, which makes it the most suitable location for inserting the stuffing material in the interior cavity of the body. Of course, a limb extension could be selected for the opening.

BRIEF DESCRIPTION OF THE DRAWING

FIGS. 2*a* and 2*b* are cross sectional views of joining means for an arm and leg, respectively, according to one embodiment of the invention;

FIG. 3 is a cross sectional view of the head and neck region of the doll of FIG. 1; and FIGS. 4*a* and 4*b* are cross sectional views of joining means for an arm and leg, respectively, in an alternate embodiment of the invention.

DETAILED DESCRIPTION OF THE INVENTION

Figure 1:
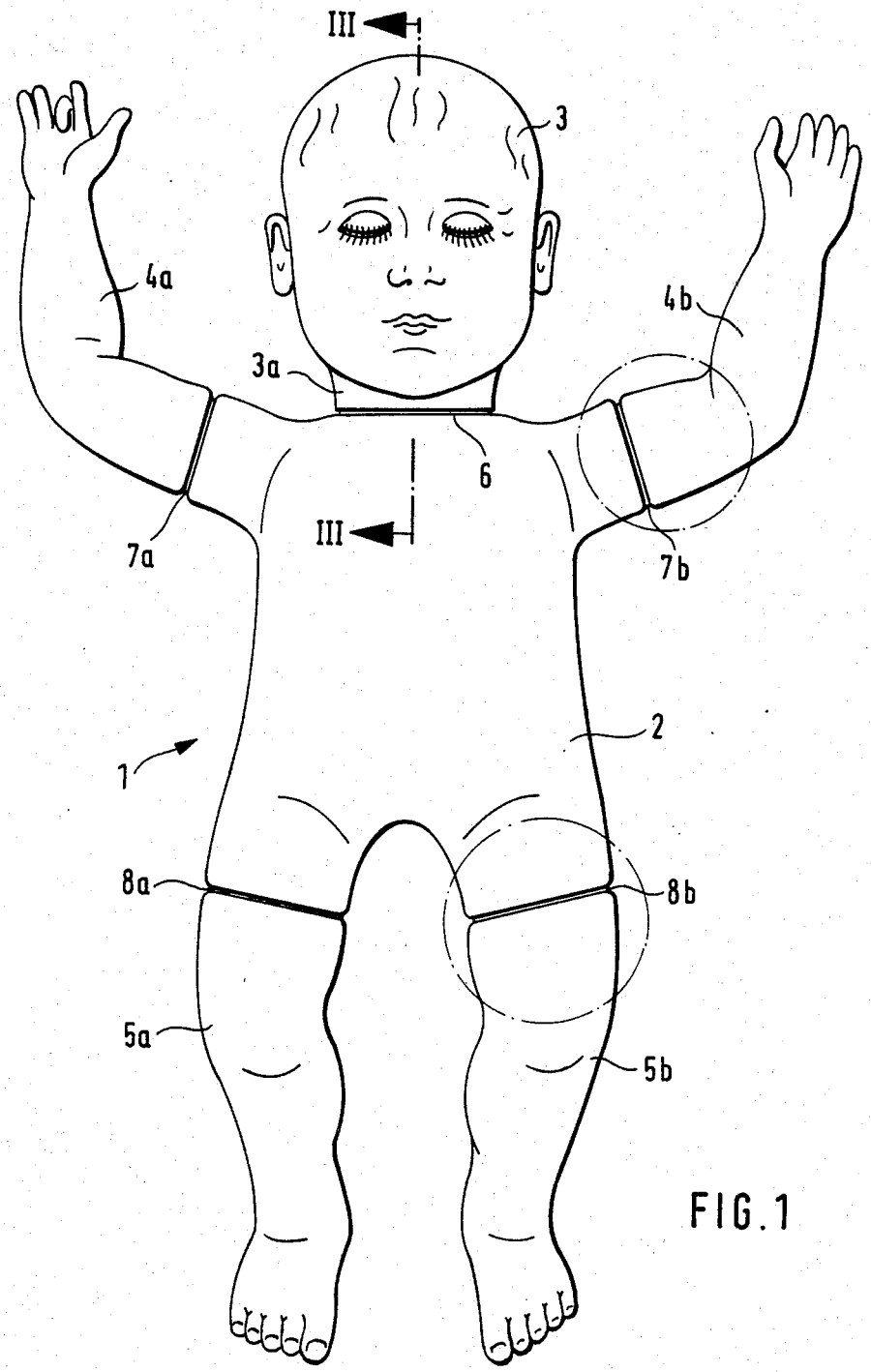
FIG. 1 is a perspective view of the batheable doll of the invention.

According to one embodiment of the invention, the arms and legs are attached to the skin of the body by pushing the closed extension by its outer side over the proximal portion of the upper arm or upper leg section. The upper arm or upper leg section includes a ring-shaped groove engageable with a tight, inelastic fastener, which may advantageously be comprised of a fabric-reinforced hard rubber or steel material.

In another embodiment of the invention, a special coupling piece is disposed in each closed extension, for attaching the arms and legs to the body skin. The upper arm or upper leg may then be readily pushed over the coupling piece which is enveloped by the corresponding extension of the body skin. The result is an interlocking connection. In order to perform this operation easily and without damage to the part of the body skin which lies between the coupling piece and the end of the neck or limb, a lubricant may be applied to the exterior surface of the extension. The extension then serves as a sealing gasket between the coupling piece and the end of the neck, upper arm, or upper leg, which gasket, under compression, prevents any liquid from penetrating into the body cavity of the doll. With this arrangement the desired position of the arms and legs can be established when the doll is assembled, which position may be in particular the correct position relative to the body; moreover, the limbs will be rotatable.

It is also advantageous to attach the head to the open neck-extension of the body skin by way of a coupling piece, or if the open body skin extension is at an arm or leg, the attachment at the location may be accomplished with a similar coupling piece. Indeed, all of the extensions may be of the open type, in which case the head, arms, and legs will all be connected to the body skin with such a coupling piece.

According to another advantageous feature of the invention the coupling piece is in the form of a flange with a circular cross section and has a ring-shaped groove encircling its circumference. This groove engages a projection firmly attached to the interior of the neck extension of the head or the interior of the proximal end of the corresponding arm or leg. Such a coupling piece can be fabricated easily and inexpensively, and is easy to manipulate and to install correctly in the sleeve extension; also, there is virtually no additional expense involved in fabricating the interior projection on the neck extension of the head or the proximal end of the corresponding arm or leg. The connection itself is easy to accomplish and is completely reliable.

It has proven to be advantageous for the coupling piece to have a shape which tapers in its circumferential region adjoining the arm or leg, with the taper or bevel beginning at an annular groove the extending toward the outer or distal end face. This facilitates the formation of the connection wherein the end of the neck or limb is pushed over the coupling piece.

It is recommended that all corners of the coupling pieces be rounded, in order to minimize wear on the body skin disposed between the coupling peice and the neck end or limb end which may occur when the connection is being made.

In a further refinement of the inventive concept, the resilient eye openings in the hollow head of the doll are covered with watertight elastic caps. This provides a reliable seal at a location which, similarly to the joint connections, is critical.

A preferred embodiment of the invention is shown in the Drawing, for purposes of example.

The batheable doll shown in FIG. 1 has a torso 1 with a skin 2 of a plastic material which is thin and completely flexible. The torso 1 has a soft stuffing, e.g. of a fiber material. The head 3, arms 4*a* and 4*b* with hands, and legs 5*a* and 5*b* with feet are also covered with a plastic material, but have a substantially thicker and stiffer skin than the torso skin 2. The members 3, 4 and 5 are attached to the torso 1 in such a way that they are rotatable.

The head 3, arms 4*a* and 4*b*, and legs 5*a* and 5*b* are joined to the torso 1 at the locations 6, 7*a* and 7*b*, and 8*a* and 8*b*, respectively. At these locations the torso skin 2 is provided with extensions. The extension which interacts with the neck 3*a* extending from the head 3 is open, while the other body skin extensions are closed. The type of the connection with variants thereof, is shown in FIGS. 2 and 4.

Two ways are exemplified in which the closed extensions of the torso skin 2 can attach to the arms 4*a* and 4*b* and the legs 5*a* and 5*b*, one of which is shown in FIGS. 2*a* and 2*b*, and the other in FIGS. 4*a* and 4*b*.

In the embodiment of FIGS. 2*a* and 2*b*, the upper arm or shoulder region of the arm 4*a* is provided with a ring-shaped groove 4*a*′, and the thigh or hip region of the leg 5*a* is provided with a ring-shaped groove 5*a*′. The other arm 4*b* and other leg 5*b* have similar grooves. To attach the arm 4*a* or leg 5*a* to the body skin 2, the corresponding extension of the skin 2 is pushed over the upper arm or upper leg region, respectively, so that its outer side is folded over, and turned until this inverted extension lies over the ring groove 4*a*′ or 5*a*′, respectively. Then a fastener such as an O-ring 15 is pushed over the grooved end of the limb from the interior of the extension, and is positioned in the ring-shaped groove 4*a*′ or 5*a*′. Finally, the arm 4*a* or leg 5*a* is pulled in the proximal direction until the position illustrated in the figures is reached.

In the embodiment of FIGS. 4*a* and 4*b*, a coupling piece 9 is illustrated. The piece 9 has basically the same form for all the connections, including that of location 6 (FIG. 1) at which the head 3 is connected to the torso skin 2.

The coupling piece 9 is circular in cross section and has an annular groove 10 extending around its circumference, which interlockingly engages an interior prominence 11 on the end of the neck 3*a* extending from the head 3, and on the proximal edges of the arms 4*a* and 4*b* and of the legs 5*a* and 5*b*, respectively. The distal region of the coupling piece 9 tapers from the annular groove 10 to the distal end face 12, to facilitate moving the interior prominence 11 past said distal region and into said groove 10 when making the connection.

As illustrated in FIG. 3, the extension of the torso skin 2, which interacts with the end of the neck 3*a*, is open. It has a collar 2*a* clamped (i.e., held under compression) between the interior prominence 11 on one side and the two flanges of the annular groove 10 on the other. The configurations of FIGS. 4*a* and 4*b* are similar, but the extensions of the torso skin 2 are closed—the coupling piece 9 completely closes off its corresponding extension, and in particular is closed off on the end face 12 of the piece 9.

The following technique is preferred for making the open connection more secure and water-tight. In the exemplary embodiment shown, this connection is that at which the open extension of the torso skin 2 interacts with the end of the neck 3*a* extending from the head 3. First, the collar 2*a* on the torso skin 2 is clamped into the annular groove 10 of the coupling piece 9 by means of an O-ring (not shown). Then the region of the collar 2*a* which projects out upwardly is folded down over the O-ring, and an adhesive is applied in the crevice which this folding-over produces between the exterior wall of the annular groove 10 and the interior side of the collar, to form a completely water-tight seal with respect to the interior space of the torso skin. After the adhesive sets, a bead of silicone is applied, and the projecting region of the collar 2*a* is then folded back upward. When the head 3 is then mounted so that the interior prominence 11 of the neck 3*a* interlockingly engages the annular groove 10 of the coupling piece 9, the bead of silicone material is squeezed out slightly, and serves as a lubricant to facilitate rotation of the head 3.

FIG. 3 also illustrates how the eye openings 13, which are set back into the head 3, can be covered with an elastic cap 14 to make them water-tight.

I claim:

1. An immersible doll having a torso, and arms and legs joined to the torso comprising:

a water impermeable skin on said torso;

a hollow sleeve extension of flexible water impermeable material integral with said water impermeable skin at each shoulder and hip portion of said torso, each sleeve extension being closed at its outer end remote from said torso so that said sleeve extensions are watertight;

arm and leg members having hollow inner ends attachable to the outer ends of said extensions at the shoulder and hip portions, respectively;

an inwardly directed flange on said hollow inner end of each arm and leg;

a laterally projecting flange extending from the inner edge of and at substantially 90° with respect to each inwardly directed flange in the direction of the respective arm and leg;

a hollow coupling member having a peripheral portion with a substantially circular cross-section within the outer closed end of each sleeve extension for connecting respective arm and leg members thereto;

an inwardly directed annular groove in the peripheral portion of each coupling member formed by inwardly directed spaced flanges and a laterally directed circular cross-section cylindrical section connected to the inner edges of said spaced flanges and extending at substantially 90° with respect thereto, said annular groove and flanges on said arm and leg members having relative dimensions to tightly interfit respectively with each other with said closed end of a respective sleeve extension held therebetween in sealing engagement therewith to allow rotation of said arm and leg members relative to respective coupling members; and a conically tapering section at the end of each coupling member insertable into said arms and legs, the larger diameter of which is adjacent said annular groove and larger in diameter than that of the respective laterally projecting flange, and the smaller diameter of which is less than the diameter of said respective laterally projecting flange, the largest diameter of the coupling member being at the outer edge of the inwardly directed flange adjacent the other end of said coupling member and being greater in diameter than the larger diameter of said conical section;

so that said conical sections and interfitting annular grooves and flanges facilitate insertion of a part of each coupling member into the inner end of respective arm and leg members with the outer end of the respective sleeve extension therebetween and retention of said arm and leg members on said sleeve extensions.

2. A doll as claimed in claim 1 wherein said arms and legs are removably engageable with said respective couplings and sleeve extensions.

3. A doll as claimed in claim 1 wherein said arms and legs are non-removably engageable with said respective couplings and sleeve extensions.

4. A doll as claimed in claim 1 wherein said skin comprises soft rubber having a thickness of about 0.2 mm to 0.8 mm, and said torso contains soft stuffing material.

5. A doll as claimed in claim 1 wherein said skin comprises soft polyvinyl chloride having a thickness of about 0.2 mm to 0.8 mm, and said torso contains soft stuffing material.

* * * * *